US006256002B1

(12) United States Patent
Shinoda

(10) Patent No.: US 6,256,002 B1
(45) Date of Patent: Jul. 3, 2001

(54) METHOD FOR DRIVING A PLASMA DISPLAY PANEL

(75) Inventor: Tsutae Shinoda, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/233,932

(22) Filed: Jan. 20, 1999

(30) Foreign Application Priority Data

Jun. 11, 1998 (JP) ..... 10-163185

(51) Int. Cl.[7] ..... G09G 3/28
(52) U.S. Cl. ..... 345/60; 345/67
(58) Field of Search ..... 345/63, 60, 67, 345/37

(56) References Cited

U.S. PATENT DOCUMENTS

| | | | | |
|---|---|---|---|---|
| 5,835,072 | * | 11/1998 | kanazawa | 345/60 |
| 5,943,031 | * | 8/1999 | Tokunaga et al. | 345/60 |
| 6,034,482 | * | 3/2000 | kanazawa et al. | 315/169.4 |
| 6,054,970 | * | 4/2000 | Hirakawa et al. | 346/60 |
| 6,072,448 | * | 6/2000 | Kojima et al. | 345/63 |
| 6,097,365 | * | 8/2000 | Makino | 345/99 |

FOREIGN PATENT DOCUMENTS 0488326A 6/1992 (EP) .

0488891A 6/1992 (EP) .

OTHER PUBLICATIONS

"Plasma Panel Write Normalizing Waveform", IBM Technical Disclosure Bulletin, vol. 28, No. 12, May 1986, p. 5263 XP002006919.

"Write and Erase Pulses With Opposite Polarities", IBM Technical Disclosure Bulletin, vol. 23, No. 12, May 1981, p. 5442/5443 XP002044301.

* cited by examiner

*Primary Examiner*—Richard Hjerpe
*Assistant Examiner*—Kimnhung Nguyen
(74) *Attorney, Agent, or Firm*—Staas & Halsey LLP

(57) ABSTRACT

A method for driving a plasma display panel having, in a display region thereof, plural first and second main electrodes disposed in parallel on each line and plural address electrodes each disposed on each column. The method includes periodically applying a first pulse for sustaining illumination to the first main electrodes, selecting k lines during every pulse base time of the periodic application of the first pulse to the first main electrodes, and applying, to the second main electrodes on non-selected lines, a second pulse whose amplitude is a voltage for sustaining illuminations and applying the scan pulse sequentially to the second main electrodes on the selected k lines, during the pulse base time.

21 Claims, 12 Drawing Sheets

H = 1 / (n LINES × 60 FIELDS)
H = W 1 + s + 1 0 Wy

| at W 1 = 3 μs , s = 1. 5 μs | | |
|---|---|---|
| n | H (μs) | Wy (μs) |
| 3 8 4 | 4 3. 4 | 3. 8 9 |
| 4 8 0 | 3 4. 7 | 3. 0 2 |
| 5 0 0 | 3 3. 3 | 2. 8 8 |
| 7 6 8 | 2 1. 7 | 1. 7 2 |
| 1 0 0 0 | 1 6. 7 | 1. 2 1 |

METHOD FOR DRIVING A PLASMA DISPLAY PANEL

CROSS-REFERENCE TO RELATED APPLICATION

This application is related to Japanese application No. HEI 10(1998)-163185, filed on Jun. 11, 1998, whose priority is claimed under 35 USC § 119, the disclosure of which is incorporated by reference in its entirety.

BACKGROUND OF THE INVENTION

1. Field of the Invention

The present invention relates to a method for driving an AC plasma display panel (hereinafter referred to as PDP) having a surface discharge structure.

PDPs have been becoming widespread as large-screen TV display devices since PDPs capable of color display were put to use. Now still higher definition PDPs are one of the market's demands. For realizing higher definition, it is necessary to speed up addressing.

2. Description of Related Art

Three-electrode AC surface-discharge PDPs are commercialized as color display devices. In a PDP of this type, a pair of main electrodes (a first electrode and a second electrode) for sustaining light emission is disposed per line (row) of a matrix for display and an address electrode (a third electrode) is disposed per column of the matrix. Ribs for preventing discharge interference between cells are formed in stripes. In the surface-discharge structure, fluorescent layers for color display are formed on a substrate opposed to a substrate on which the pairs of main electrodes are disposed. Thereby deterioration of the fluorescent layers by ion impact at discharges can be reduced and thus the life of the PDP can be extended. PDPs of reflection types which have the fluorescent layers on their rear substrates are superior in luminous efficiency to those of "transmission type" which have the fluorescent layers on their front substrates.

A memory function is utilized for display. The memory function is attributed to charge accumulated on a dielectric layer covering the main electrodes. More particularly, addressing is performed by line-by-line scanning for producing a charged state according to the content of display, and a sustain voltage Vs of alternating polarity is applied on the main electrode pair of each line for sustaining illumination. The sustain voltage satisfies the following formula (1):

$$Vf-Vwall<Vs<Vf \qquad \text{Formula (1)}$$

wherein Vf is a firing voltage and Vwall is a wall voltage.

When the sustain voltage is applied, an effective voltage (also referred to as a cell voltage) exceeds the firing voltage only in cells where wall charge is present, so that a surface discharge is generated along the face of the substrate in the cells. By applying the sustain voltage Vs in a short cycle, it is possible to obtain an illumination state which appears continuous.

The luminance of display depends on the number of discharges per unit time. Accordingly, halftones are reproduced by setting the number of discharges in one field for every cell in accordance with levels of gradation to be produced. Color display is one sort of gradation display, and a displayed color is determined by combination of luminances of the three primary colors. In the present specification, the "field" means a unit image, and a number of unit images are displayed in time sequence for reproducing an image. That is, the field is a field of a frame displayed by interlaced scanning in the case of television and is a frame itself in the case of non-interlaced scanning (which is regarded as a one-to-one interlaced scanning) typified by computer output.

In order to produce levels of gradation by the PDP, the field is time-sequentially divided into a plurality of sub-fields. The luminance (i.e., the number of discharges) in each sub-field has a weight. The total number of discharges in the field is determined by combining illuminations and non-illuminations on a sub-field basis. If the application cycle (driving frequency) of the sustain voltage Vs is constant, the sustain voltage Vs is applied for different time periods for different luminance weights. Basically, the sub-fields are assigned so-called "binary weights" represented by $2^q$ (q=0, 1, 2, 3, . . . ). For example, if the number K of sub-fields in one fields is 8, 256 ($2^8$) levels of gradation from "0" to "255" can be produced. The binary weights are free of redundancy and suitable for multi-gradation display. In some cases, however, different sub-fields are purposely assigned the same weight for preventing pseudo-contour with moving pictures or the like.

A method in which plural lines are simultaneously driven is known as a method for driving PDPs to realize the gradation display.

FIG. 10 is a time chart of the multi-line simultaneous driving method, explaining the outline of the timing of selecting lines. Here, for simplicity of explanation, an example of display of 16 levels of gradation with four bits is shown and a screen has a line number n of 480. The abscissa of the time chart represents time and the ordinate thereof represents the position of pixels in a direction of rows on the screen. Oblique solid and dotted lines in the time chart represent scanned positions, i.e., selected lines, at points in time. The screen is a set of lines to be scanned and is sometimes equal to part of a set of cells arranged in matrix. For example, in the case of a dual scanning method in which the addressing is executed separately to two sections into which the cells are divided in a direction of columns, each of the sections is a screen. In the case where the addressing is executed separately to even lines and to odd lines, the set of even lines and that of odd lines each compose a screen.

A field time Tf divided by the number n of lines, Tf/n, is a scanning time period H (line selecting time period) for scanning one line in each of the sub-fields sf1, sf2, sf3 and sf4. The sub-fields sf1 to sf4 are assigned binary weights of 1:2:4:8, respectively. Accordingly, time allotted to the sub-fields sf1 having the weight of "1" is 32(=1×480/(1+2+4+8))H. Times allotted to the sub-fields Sf2, sf3 and sf4 are 64H, 128H and 256H, respectively. The addressing and the sustaining of illumination are executed within these times allotted to the sub-fields sf1 to sf4.

In the example of FIG. 10, display of the sub-fields sf1 to sf4 is executed in order of the weights. The lines are selected from the first line to the last line in order of arrangement. In other words, from the view point of each line, the first line is selected for the sub-field sf2 32H after selected for the sub-field sf1. Then 64H later, the line is selected for the sub-field sf3, and then 128H later, the line is selected for the sub-field sf4. Further 256H later, the line is selected for the sub-field sf1 of the next field. The second line is selected 1H after the first line is selected, and the third line is selected 1H after the selection of the second line. Thus, the lines are selected at intervals of 1H in order of their arrangement in each of the sub-fields sf1 to sf4.

In this way, from the view point of the individual lines, the selection of a line is 1H behind the selection of the previous line in each of the sub-fields sf1 to sf4. However, from the view point of the whole screen, the selection of lines for the four sub-fields sf1 to sf4 is performed in the period of 1H. More particularly, as indicated by black dots in the figure, when a first line is selected in the sub-field sf1 of a certain field, the selection of lines for the sub-fields sf2, sf3 and sf4 of the previous field is also performed. In other words, four lines are selected at the same time on the whole screen. At this time, the selected four lines are apart from each other by the numbers of lines corresponding to the weights of luminance assigned to the sub-fields sf1 to sf4. In the example shown in FIG. 10, selected are the first line, the 257th line apart from the first line by 256 lines, the 385th line apart from the 257th line by 128 lines, and the 449th line apart from the 385th line by 64 lines. As discussed above, the selection of lines proceeds one line per 1H. Therefore, when the second line is selected, the 258th line, 386th line and 450th line are selected.

In the multi-line simultaneous driving method, the same number of lines as the number K (k is four in the example) into which the lines are divided are selected at the same time. Actually, since it is impossible to simultaneously address a plurality of lines using one address electrode, the selection of lines for the sub-fields sf1 to sf4 is performed in time-sequential order within the period of 1H.

FIG. 11 and FIG. 12 illustrate voltage waveforms explaining conventional driving sequences.

In the conventional driving sequences, a sustain pulse Ps for sustaining illumination is alternately applied to pairs of main electrodes Xi and Yi (i=1 to n) of the lines with a timing common to all the lines, and a scan pulse Py is applied to the main electrode Yi with such a timing that the scan pulse Py does not overlap the sustain pulse Ps.

When the field is divided into four, the scan time period H for scanning four lines for the sub-fields sf1 to sf4 is divided into four, and the scan pulse Ps is applied to one line within the period of 1/4H. Though not shown, an address pulse is selectively applied to the address electrode in synchronization with the scan pulse. Thus, only in a cell on the selected line which is on a column to which the address pulse is applied, an address discharge is generated to produce a wall charge. The Examples of FIGS. 11 and 12 explain a write addressing. Accordingly, the wall charge is erased by an erase pulse Pe prior to applying the scan pulse Py, and the address discharge produces the wall charge again in such an amount as required for sustaining illumination. In the cell where the wall charge has been re-produced, a discharge for sustaining illumination is generated and switch the polarity of the wall charge every time the sustain pulse Ps is applied, until the erase pulse Pe is applied next.

The conventional driving sequences have the problem that a cycle (H/k) for applying the scan pulse Py is larger than the sum of the pulse width of the scan pulse Py and double the pulse width of the sustain pulse Ps and therefore the addressing takes a long time. For this reason, the conventional driving sequences cannot be adapted to a high-definition PDP having more than 480 lines for producing full-motion display with sufficient levels of halftone. In this connection, it is possible to halt the application of the sustain pulse Ps for a while, during which the scan pulse Ps is applied, and thus to reduce the time necessary for the addressing. In this case, however, it is necessary to separately control not only the main electrode Yi to which the scan pulse is applied but also the other main electrode Xi. Accordingly, the driving circuit becomes more complicated and costs more compared with the case where the main electrodes Xi are controlled in common.

SUMMARY OF THE INVENTION

An object of the present invention is to speed up the addressing of the multi-line simultaneous driving, which has advantage for displaying increased levels of gradation.

In the present invention, generally, a sustain pulse for sustaining illumination is applied alternately to a first main electrode and a second main electrode of each line (row) with a timing common to all lines (intentional small time lags are intended, however), except that a scan pulse for line selection instead of the sustain pulse is applied to the second main electrode of a selected line during a period in which the second main electrodes of the other lines receive the sustain pulse. If a field is divided into time-sequential k sub-fields, k scan pulses for addressing fork sub-fields are applied one by one while one sustain pulse is applied to the second main electrode. Thereby, a scan period H for one line in each sub-field equals a cycle of application of the sustain pulse to the first main electrode.

The present invention provides a method for driving a plasma display panel having in a display region thereof a plurality of first main electrodes and a plurality of second main electrodes disposed in parallel to form electrode pairs for generating a discharge for sustaining illumination on each line and a plurality of address electrodes each disposed on each column, the plasma display panel being driven by applying a scan pulse for line selection to the second main electrodes in a specific order while applying an address pulse selectively to the address electrodes according to display data in synchronization with the application of the scan pulse, thereby to prepare a proper wall charge in each cell on a line basis, the method comprising the steps of periodically applying a first pulse for sustaining illumination to the first main electrodes, selecting k lines, wherein k is an integer of 1 or more, during every pulse base time of the periodic application of the first pulse to the first main electrodes, and applying, to the second main electrodes on non-selected lines, a second pulse whose amplitude is a voltage for sustaining illumination, and applying the scan pulse sequentially to the second main electrodes on the selected k lines, during the pulse base time.

The present invention also provides a method for driving a plasma display panel having, in a display region of m columns×n lines, a plurality of first main electrodes and a plurality of second main electrodes disposed in parallel to form electrode pairs for generating a discharge for sustaining illumination on each of the lines and m address electrodes disposed on each of the columns, a field being divided into k sub-fields each assigned a weight of luminance for reproducing levels of gradation, wherein k is an integer of one or more, for displaying time-sequential fields with the plasma display panel, the plasma display panel being driven by applying a scan pulse for line selection to the second main electrodes in a specific order during each of the sub-fields while applying an address pulse selectively to the address electrodes according to display data in synchronization with the application of the scan pulse, thereby to execute addressing on a line basis to prepare a proper wall charge in each cell, the method comprising the steps of periodically applying a first pulse for sustaining illumination to the first main electrodes, selecting k lines, wherein k is an integer of 1 or more, so that addressing is performed for k sub-fields having different weights of luminance out of 2k sub-fields corresponding to two sequential fields, during every pulse base time of the periodic application of the first pulse to the first main electrodes, and applying, to the second main electrodes on non-selected lines, a second pulse whose amplitude is a voltage for sustaining illumination, and applying the scan pulse sequentially to the second main electrodes on the selected k lines, during the pulse base time.

DESCRIPTION OF THE PREFERRED EMBODIMENTS

Figure 1:
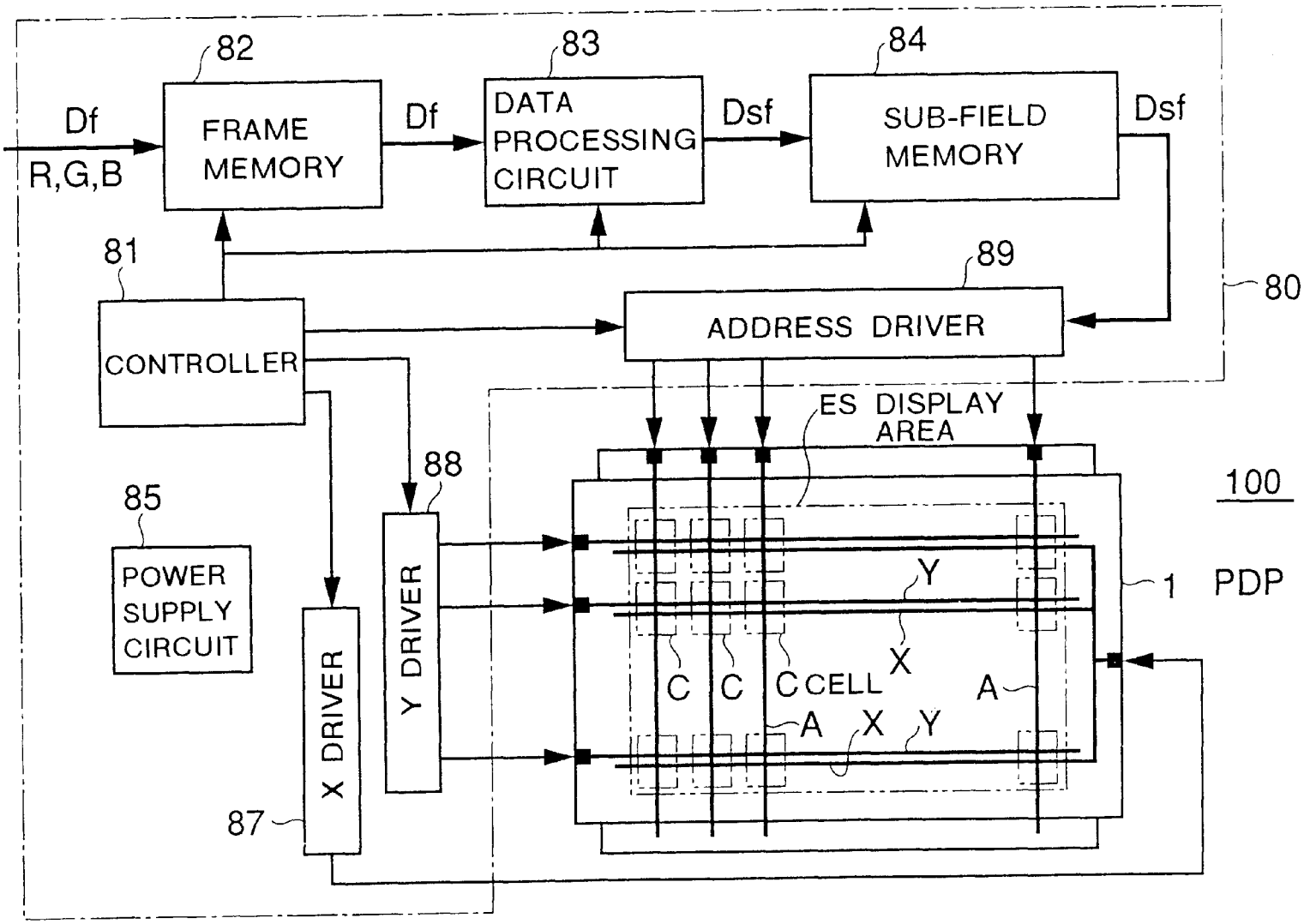
FIG. 1 is a diagram illustrating the structure of a PDP in accordance with the present invention.

According to the present invention, during each pulse base time, the k lines may be selected in order of arrangement of the lines and the k lines are apart from each other by the numbers of lines corresponding to the weights of luminance assigned to the sub-fields.

Here, k may be 4.

The second pulse applied to the second main electrodes may have a larger pulse width than that of the first pulse applied to the first main electrodes.

In a pulse base time in which the scan pulse is applied to the second main electrode, a third pulse whose pulse width is large enough to include the second pulse to be applied in the next pulse base time may be applied to the second main electrode immediately after the application of the scan pulse.

The second pulse may include an erase pulse for erasing wall charge and a sustain pulse for sustaining illumination, the erase pulse having a gradually increasing voltage and being applied during the pulse base time to the second main electrode on a non-selected line that will be selected in a pulse base time later than said pulse base time, the sustain pulse having a quickly increasing voltage and being applied during the pulse base time to the second main electrodes on other non-selected lines.

During each pulse base time, the second pulse for sustaining illumination may be applied to the second main electrodes on all the non-selected lines and, in synchronization with the next application of the first pulse to the first main electrode, an erase pulse for generating a discharge for erasing wall charge may be applied to the second main electrode on a non-selected line that will be selected in the next pulse base time.

During each pulse base time, the first scan pulse may be applied a pre-set time after a rising edge of the second sustain pulse applied to the second main electrodes on the non-selected lines, the pre-set time being sufficient for inversion of the polarity of wall charge on the non-selected lines.

In another aspect, the present invention provide a method for driving a plasma display panel having in a display region thereof a plurality of first main electrodes and a plurality of second main electrodes disposed in parallel to form electrode pairs for generating a discharge for sustaining illumination on each line and a plurality of address electrodes each disposed on each column, the plasma display panel being driven by applying a scan pulse for line selection to the second main electrodes in a specific order while applying an address pulse selectively to the address electrodes according to display data in synchronization with the application of the scan pulse, thereby to prepare a proper wall charge in each cell on a line basis, the method comprising the steps of periodically applying a first pulse for sustaining illumination to the first main electrodes, selecting k lines, wherein k is an integer of 1 or more, during every pulse base time of the periodic application of the first pulse to the first main electrodes, and applying, to the second main electrodes on non-selected lines except second main electrodes to be selected in the next pulse base time, a second pulse whose amplitude is a voltage for sustaining illumination, and applying the scan pulse sequentially to the second main electrodes on the selected k lines, during said every pulse base time.

During said every pulse base time, an erase pulse for generating a discharge for erasing the wall voltage may be applied to the second main electrodes to be selected in the next pulse base time.

FIG. 1 is a diagram illustrating the structure of a plasma display device 100 in accordance with the present invention.

The plasma display device 100 includes an AC plasma display panel (PDP) 1 which is a thin color display device of matrix type and a drive unit 80 for selectively illuminating a great number of cells C composing a screen ES of m columns×n lines (rows) The plasma display device 100 can be used as a wall-mountable TV display, a monitor of a computer system or the like.

The PDP 1 is a three-electrode surface-discharge PDP having pairs of first and second main electrodes X and Y for generating discharges to sustain illumination which are disposed in parallel and address electrodes A as third electrodes which cross the main electrodes X and Y in the cells C. The main electrodes X and Y extend in a direction of lines (in a horizontal direction) of the screen. The main electrodes Y are used as scan electrodes for selecting a cell C line by line in the addressing. The address electrodes extend in a direction of columns (in a vertical direction) of the screen and are used as data electrodes for selecting the cell C column by column. The screen (i.e., a display area) ES is an area on a substrate in which the main electrodes cross the address electrodes.

The drive unit 80 has a controller 81, a frame memory 82, a data processing circuit 83, a sub-field memory 84, a power supply circuit 85, an X driver 87, a Y driver 88 and an address driver 89. The drive unit 80 is placed on a rear side of the PDP 1. The drivers are electrically connected with the electrodes of the PDP 1 by flexible cables, not shown. Field data Df is input to the drive unit 80 from external equipment such as a TV tuner, a computer or the like together with various synchronizing signals. The field data Df represents levels of luminance (levels of gradation) of colors R, G and B on a pixel basis.

The field data Df is stored in the frame memory 82, and then sent to the data processing circuit 83. The data processing circuit 83 is data conversion means for setting combinations of sub-fields in which the cells are illuminated, and outputs sub-filed data Dsf according to the field data Df. The sub-field data Dsf is stored in the sub-field memory 84. The value of each bit in the sub-field data represents illumination or non-illumination of a cell C in a sub-field, more strictly necessity or unnecessity of an address discharge.

The X driver 87 is for applying a drive voltage to the first main electrodes X at the same time. This electric unity of the main electrodes X may be brought not only by wire connections on the panel which are shown in the figure, but also by internal connections in the X driver 87 or by connections on flexible cables. The Y 88 driver is for separately applying a drive voltage to the second main electrodes Y on the lines. The address driver 89 is for applying a drive voltage to the address electrodes A according to the sub-field data Dsf. These drivers are supplied with electricity by the power supply circuit 85.

Figure 2:
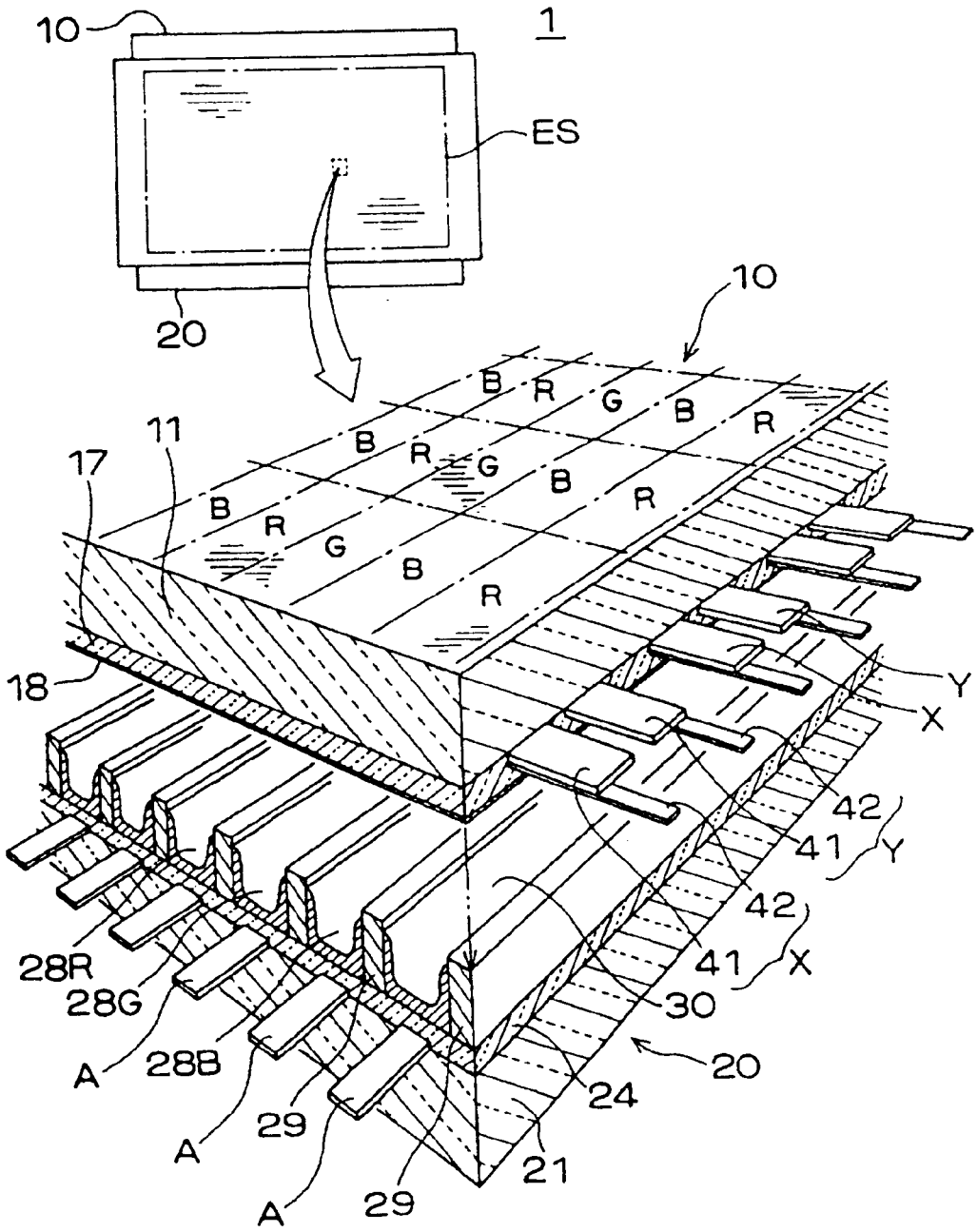
FIG. 2 is a perspective view illustrating an inner construction of a PDP in accordance with the present invention.

FIG. 2 is a perspective view illustrating an inner construction of the PDP 1.

In the PDP 1, a pair of the main electrodes X and Y is disposed on every line on an inner surface of a glass substrate 11 which is a front structural base. The line is a set of cells aligned in the horizontal direction on the screen. Each of the main electrodes X and Y is composed of an electrically conductive transparent film 41 and a metal film (a bus conductor) 42 and covered with a dielectric layer 17 of a low-melting glass of about 30 $\mu$m thick. On the surface of the dielectric layer 17, provided is a protection film 18 of magnesia (MgO) of several thousand angstrom thick. The address electrodes A are arranged on an inner surface of a glass substrate 21 which is a rear structural base, and covered with a dielectric layer 24 of about 10 $\mu$m thick. On the dielectric layer 24, provided are ribs 29 of 150 $\mu$m thick whose plan view shows linear bands, with each rib at each interval between the address electrodes A. The ribs 29 partitions a discharge space 30 into sub-pixels (light-emitting unit areas) in the line direction, and define a spacing for the discharge space 30 between the substrates. Fluorescent layers 28R, 28G and 28B of three colors R, G and B are provided for color display so as to cover the inner surface of the rear structure including areas above the address electrodes A, side walls of the ribs 29. The discharge space 30 is filled with a discharge gas of a mixture of neon as the main component and xenon. The fluorescent layers 28R, 28G and 28B are locally excited by ultraviolet rays radiated by xenon when a discharge takes place and emit light. One pixel for display is composed of three sub-pixels aligned in the line direction. A structural unit of each sub-pixel is a cell (display element) C. Since the ribs 29 are arranged in a stripe pattern, a portion of the display space 30 corresponding to one column is continuous in the column direction bridging all the lines L. The interval between the electrodes of adjacent lines is set to be sufficiently larger than a surface discharge gap (e.g., within the range from 80 $\mu$m to 140 $\mu$m) to prevent a discharge coupling in the column direction (the interval is within the range from 400 $\mu$m to 500 $\mu$m, for example).

For displaying a picture by the PDP, a surface discharge is generated along the substrate in cells which are to illuminate according to data of the picture. For this purpose, the address discharge is generated across the main electrodes Y and the address electrodes A in cells to illuminate (in the case of the write addressing) or in cells not to illuminate (in the case of the erase addressing), so that a proper amount of wall charge are allowed to exist only in the cells to illuminate. Then, the cells in which such a charged state is created can generate a surface discharge to emit light on receiving the sustain voltage Vs across their main electrodes X and Y.

Explanation is now given to how to drive the PDP 1 in the plasma display device 100.

A driving method applied to the PDP 1 is also a multi-line simultaneous driving method basically. Accordingly, the time chart shown in FIG. 10 can be referred to for the outline of the selection of a line.

Figure 10:
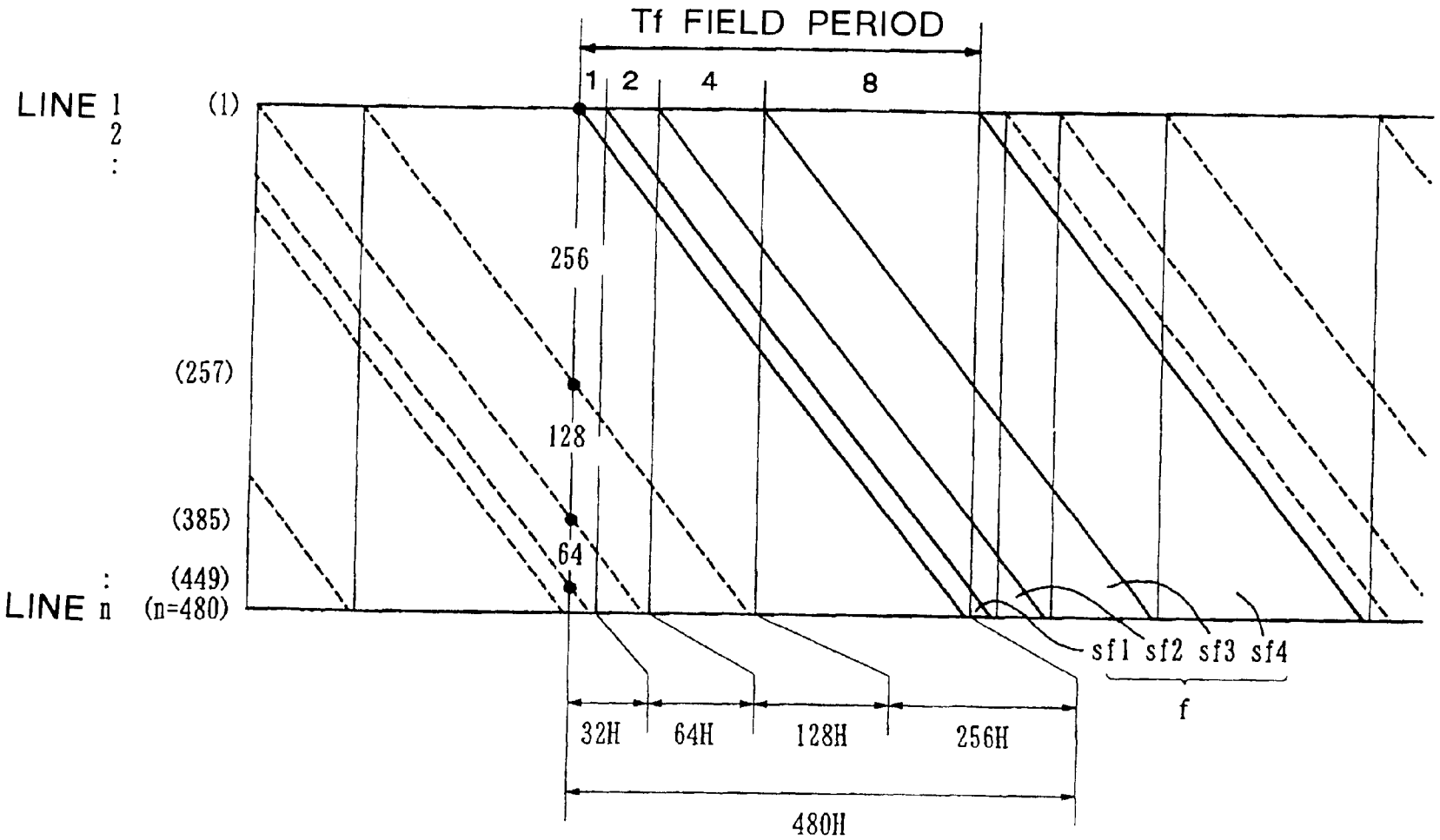
FIG. 10 is a time chart explaining a multi-line simultaneous driving method.
Figure 11:
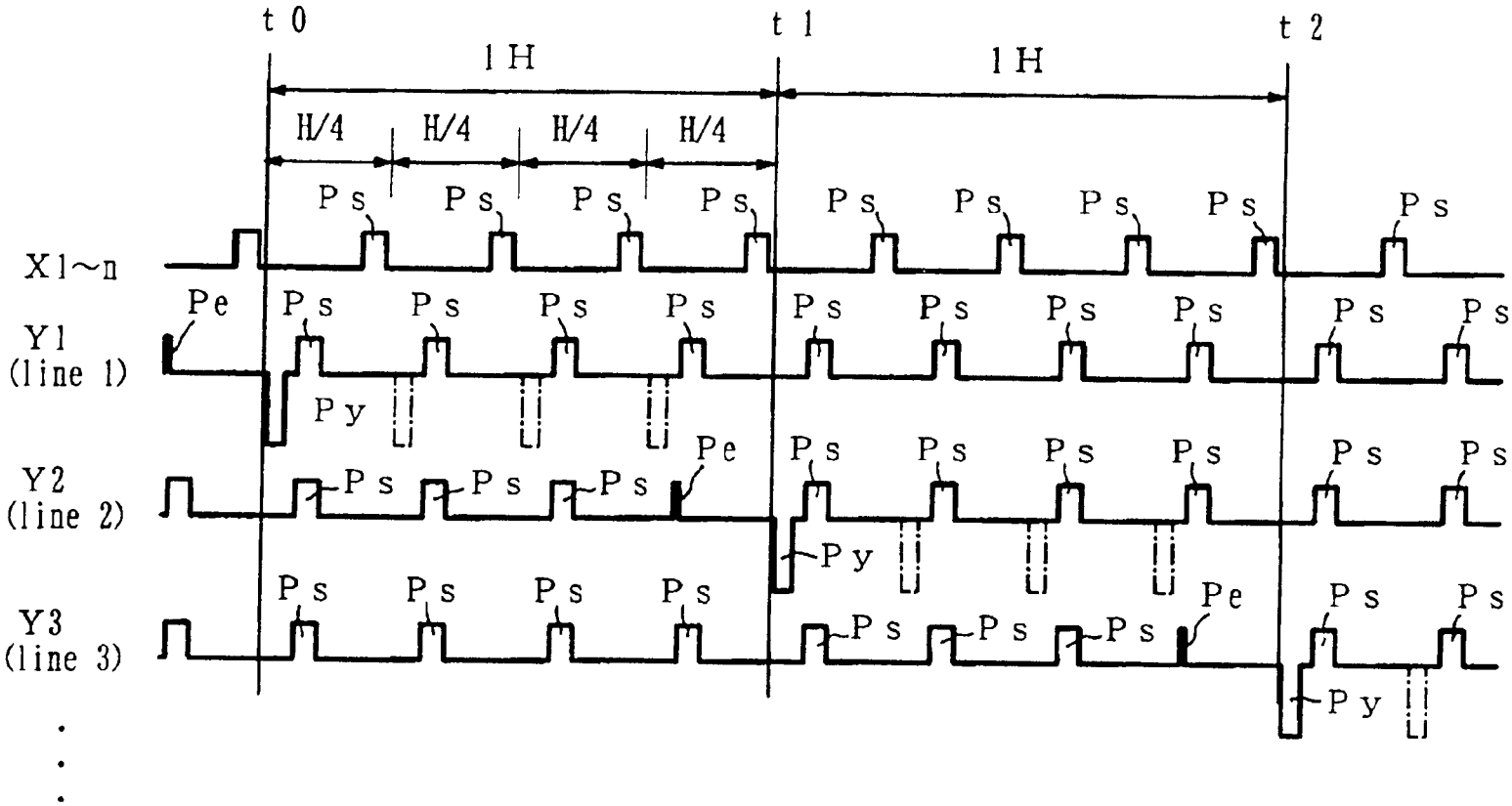
FIG. 11 RELATED ART
FIG. 11 illustrates voltage waveforms explaining a conventional driving sequence.
Figure 12:
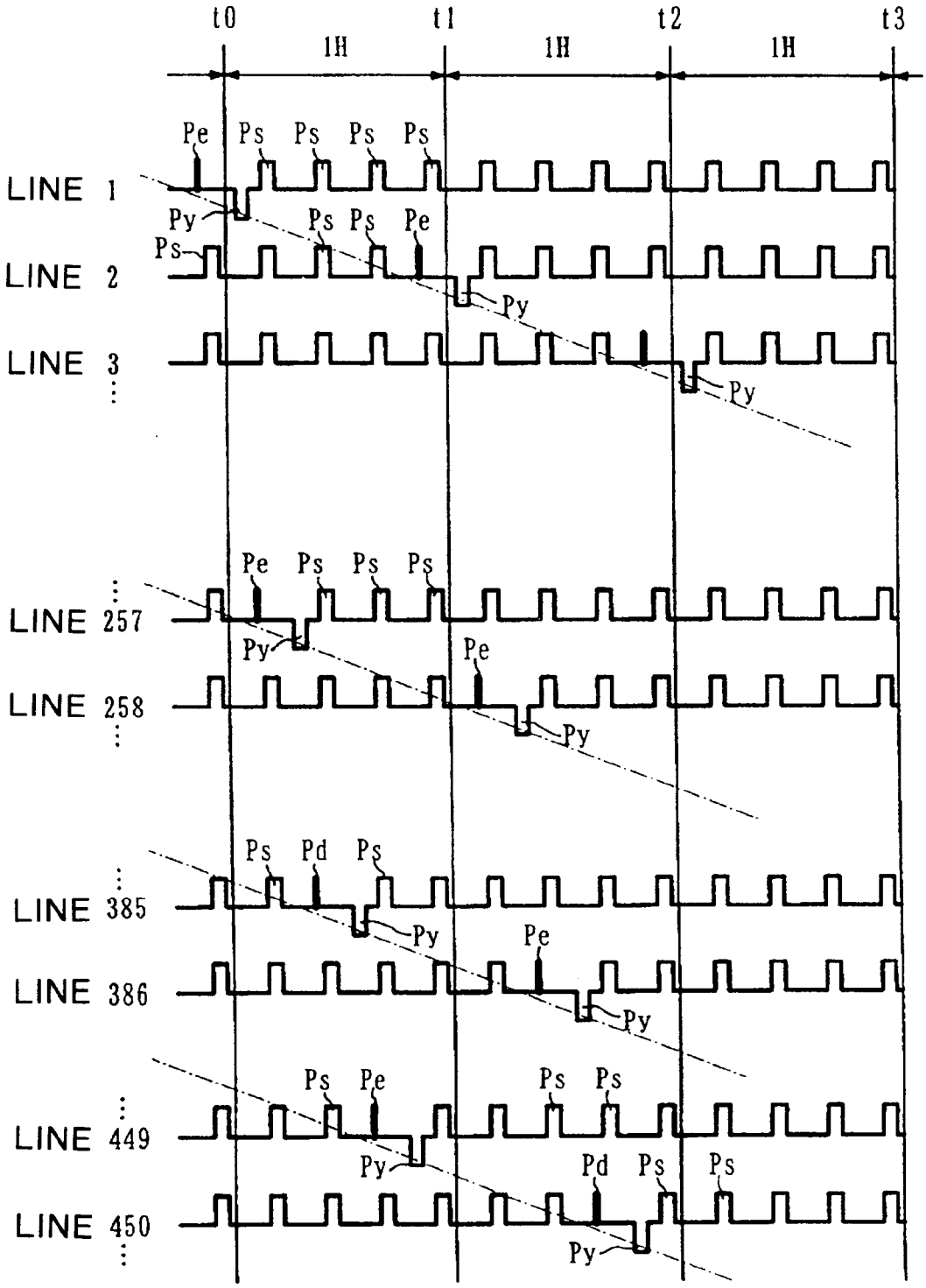
FIG. 12 RELATED ART
FIG. 12 illustrates voltage waveforms explaining another conventional driving sequence.

As already discussed with reference to FIG. 10, for reproducing levels of gradation by binary control on illumination in displaying TV pictures, fields f which are input time-sequential images are each divided into k (k is an integer not less than 1 and is 4 in FIG. 10) sub-fields, sf1, sf2, . . . and sfk (sf1, sf2, sf3 and sf4in FIG. 10). In other words, each of the fields f composing a frame is replaced with a set of k sub-fields, sf1 to sfk. In this connection, in the case of reproducing a non-interlaced image such as an output of a computer, each frame is divided into k. The sub-fields sf1 to sf4, for example, are assigned weights of luminance so that the relative ratio of luminance in the sub-fields sf1 to sf4 is 1:2:4:8, and the number of discharges for sustaining illumination is set for each of the sub-fields according to the weight of luminance assigned thereto. By combining illuminations/non-illuminations on a sub-field basis, $2^k$ levels of luminance can be set for every one of the colors R, G and B. Therefore, the number of colors able to be displayed is $2^{3k}$. The sub-fields sf1 to sf4 need not be displayed in the order of their weights of luminance. For example, the sub-field sf4 having the largest weight of luminance can be put in the middle of a field period Tf for optimization.

Figure 3:
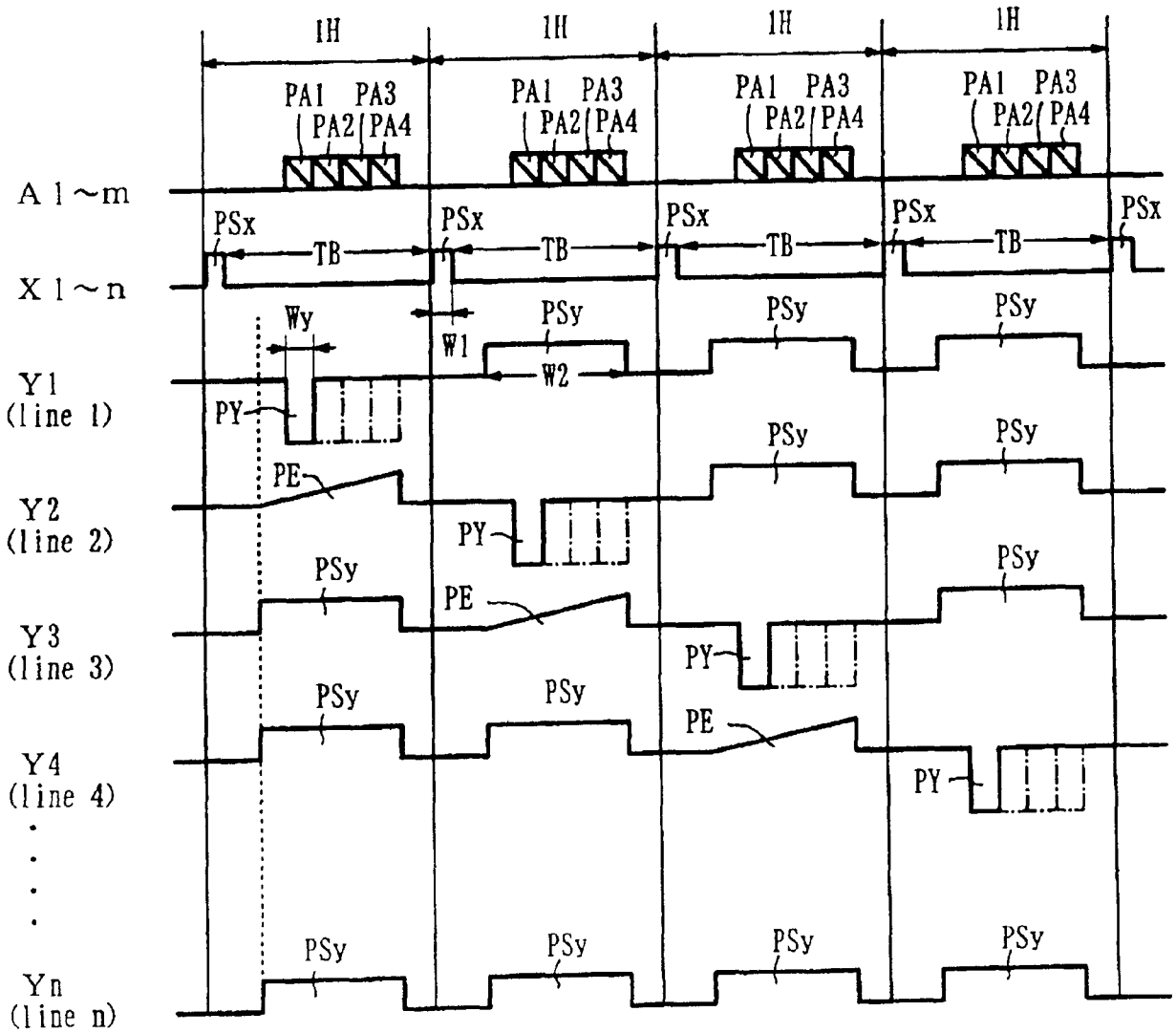
FIG. 3 illustrates voltage waveforms explaining an exemplary driving sequence in accordance with the present invention.
Figure 4:
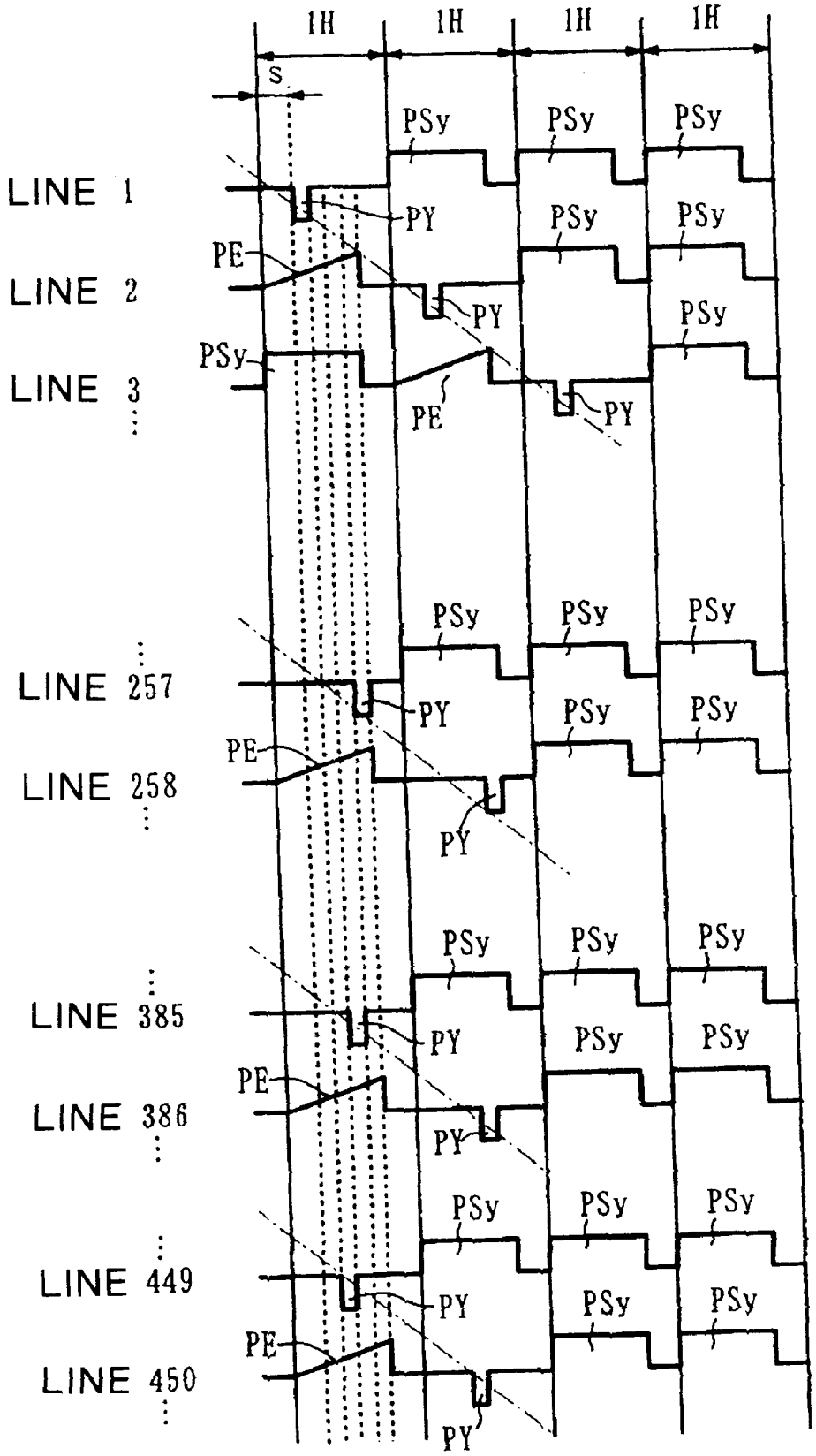
FIG. 4 illustrates voltage waveforms explaining another exemplary driving sequence in accordance with the present invention.
Figure 5:
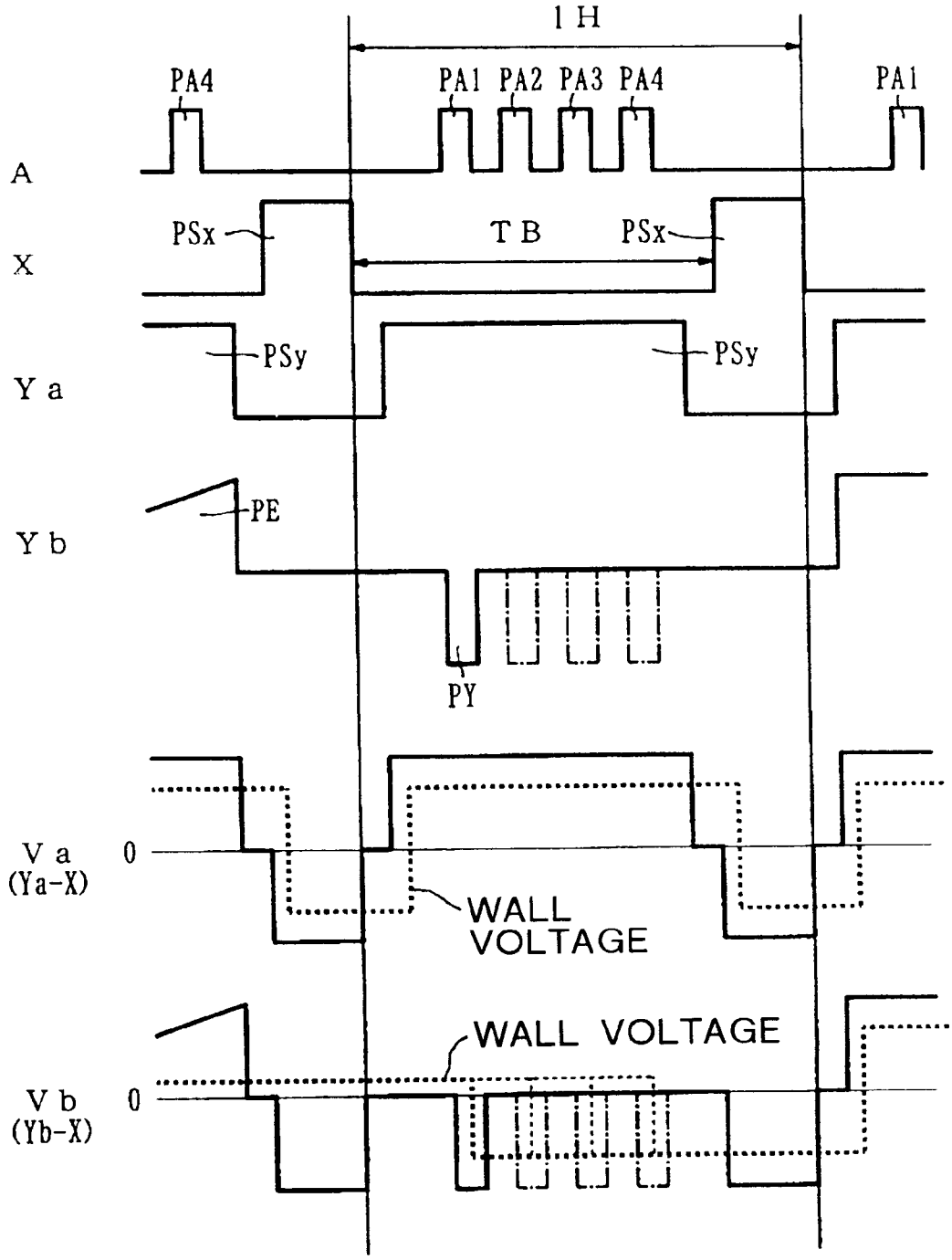
FIG. 5 illustrates voltage waveforms showing change in wall voltage on a selected line and on a non-selected line in accordance with the present invention.

FIGS. 3 and 4 illustrate voltage waveforms explaining an exemplary driving sequence in accordance with the present invention. FIG. 5 illustrates voltage waveforms showing changes in wall voltages on a selected line and on a non-selected line. In these figures, the signs X and Y of the main electrodes are accompanied by numerical subscripts 1, 2, . . . , n representative of the order of the correspondent lines, and the signs A of the address electrodes are accompanied by numerical subscripts 1, 2, . . . , m representative of the order of the correspondent columns. The same goes for the figures described later.

A sustain pulse PSx whose amplitude is the sustain voltage Vs is periodically and constantly applied to the main electrodes Xi (i=1, 2, . . . , n) of all lines to be subjected to addressing in common. The sustain voltage is a voltage satisfying the formula (1).

In every pulse base time period TB in the application of the pulse to the main electrode Xi, k lines are selected in such a manner that addressing is Haz performed for the k sub-fields among 2k sub-fields of two sequential fields, the k sub-fields having different weights of luminance. In each pulse base time TB, a sustain pulse PSy of positive polarity which has an amplitude of the sustain voltage or an erase pulse PE is applied to main electrodes (referred to as a main electrode Ya) correspondent to a non-selected line. While the sustain pulse PSy or the erase pulse PE is applied, a scan pulse PY of negative polarity is applied sequentially to k main electrodes (referred to as main electrodes Yb) correspondent to the selected lines.

The erase pulse PE is a pulse in the shape of a tooth of a saw whose voltage gradually rises, and is applied to the main electrode Ya of a non-selected line which will be selected in the next pulse base time TB. The sustain pulses PSx and PSy are pulses in the shape of a rectangle whose voltage rises steeply. When the sustain pulse PSx or PSy is applied to a cell having a proper amount of wall charge, a surface discharge of a predetermined power is generated and wall charge of reverse polarity is reproduced. When the erase pulse PE is applied, on the contrary, wall charge is not reproduced and thus the wall charge is erased. The erase pulse PE may be a pulse whose width is smaller than that of the sustain pulse PSx. The erase pulse PE does not have to be applied necessarily in this pulse base time TB, but may be applied in the preceding pulse base time TB. In this case, no pulse is applied o the non-selected main electrodes during this pulse base time. The pulse width W2 of the sustain pulse PSy may be the same as the pulse width W1 of the sustain pulse PSx applied to the main electrodes X1 to Xn in view of the reproduction of wall charge sufficient for the next discharge. However, for stable driving, the main electrodes Ya are preferably biased to the sustain voltage before the application of the k scan pulses are started until it was finished. For biasing in such a way, the pulse width W2 of the sustain pulse PSy becomes larger than the pulse width W1 of the sustain pulse PSx as the number k of the scan pulses which are applied during the pulse base time increases.

To the m address electrodes Aj (j=1, 2, . . . , m), on the other hand, address pulses PA1 to PAk (PA1, PA2, PA3 and PA4 in the figure) of positive polarity are applied selectively according to the sub-field data Dsf in synchronization with the scan pulse PY. The address pulses PA1, PA2, PA3 and PA4 correspond to the sub-fields sf1, sf2, sf3 and sf4, respectively. In this embodiment, since the selection of lines proceed one line ahead in order of arrangement of the lines in every pulse base time TB, k lines selected in the pulse base time TB are apart from each other by the numbers of lines corresponding to the weights of luminance assigned to the sub-fields sf1 to sf4 (i.e., the lengths of allotted periods). In each pulse base time, the application of the first scan pulse PY and address pulse PA may be executed at the same time as the application of the sustain pulse PSy, but preferably it is delayed by a time period s, e.g., about 1.5 $\mu$s, in consideration of the completion of the inversion of the polarity of the wall charge on the non-selected lines. For the wall charge is surely reproduced on the non-selected lines, which will improve reliability of illumination sustaining operation afterward.

By applying the scan pulse PY and address pulses PA1 to PA2 in this manner, the amount of wall charge in each cell is set to answer necessity or unnecessity of sustaining illumination, on one line at every application of the scan pulse and on k lines during every pulse base period TB.

As shown in FIG. 5, on the non-selected line, the polarity of the wall voltage is inverted with change in relative voltage across the main electrodes X and Ya at every application of the sustain pulses PSx and PSy. On the selected line, the wall voltage becomes almost zero by the application of the erase pulse PE. In this state, even if the sustain pulse PSx is applied, the surface discharge does not take place and the wall voltage does not change. Then, when the scan pulse PY and the address pulses PA1 to PA4 are applied (i.e., the addressing is performed), a predetermined wall voltage is generated. This wall voltage, however, is of different polarity from that of the sustain pulse PSx. For this reason, the surface discharge does not take place at application of the sustain pulse PSx immediately after the addressing, and therefore, the wall voltage does not change. Then, when the sustain pulse PSy is applied, the surface discharge occurs and the polarity of the wall voltage is inverted. Thereafter, the polarity of the wall voltage is inverted every time when the sustain pulses PSx and PSy are applied.

Figure 6:
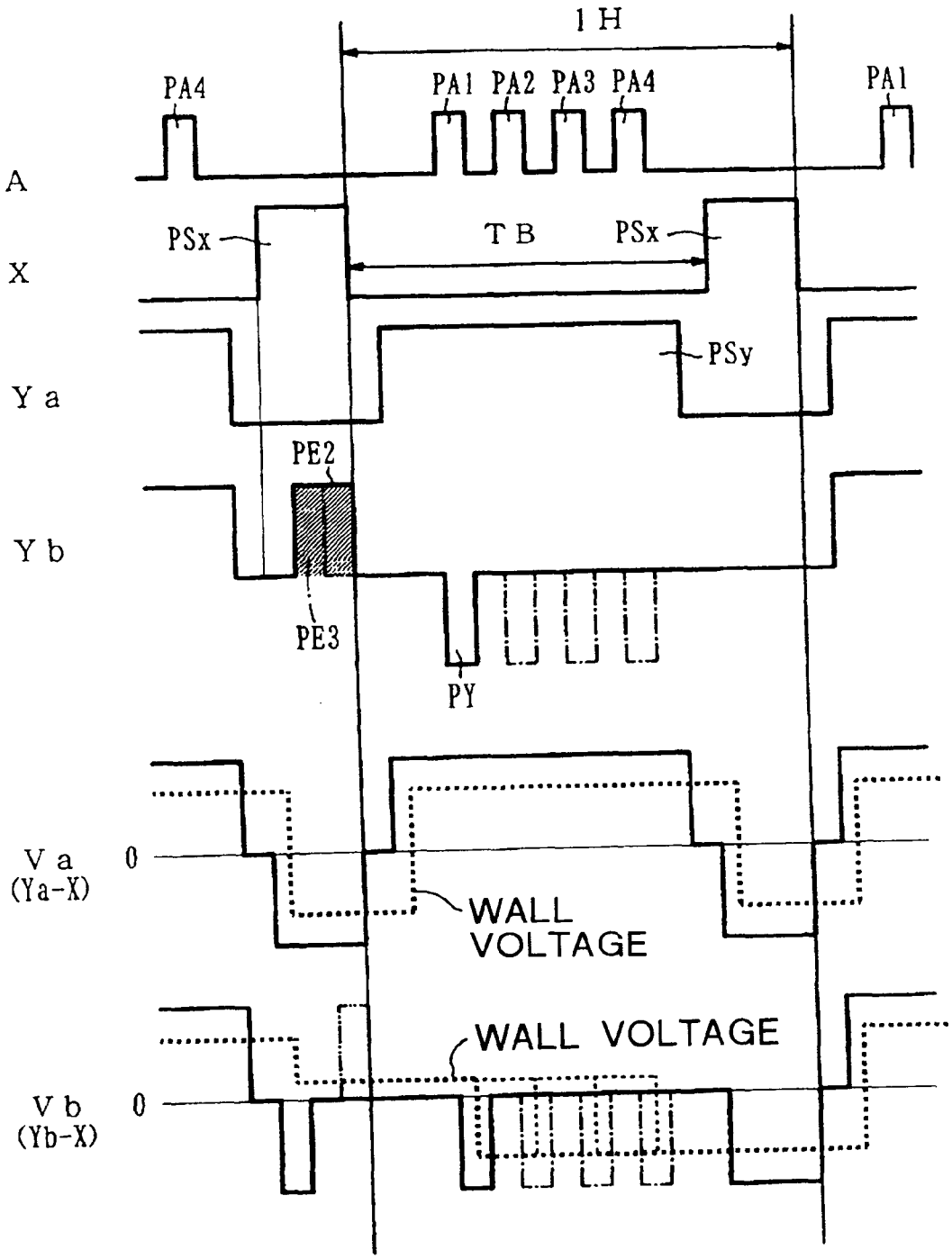
FIG. 6 illustrates voltage waveforms explaining a first modification related to the erasure of wall voltage in accordance with the present invention.

FIG. 6 illustrates voltage waveforms explaining a first modification with regard to the erasure of wall voltage.

In the above-described sequence, the erase pulse PE having a saw-tooth waveform is applied instead of the sustain pulse PSy to the non-selected line that will be selected next, in order to erase the wall charge. In the sequence shown in FIG. 6, the sustain pulse PSy is applied commonly to the main electrodes Ya of all non-selected lines. Then, while the sustain pulse PSx is being applied to the main electrodes X, an erase pulse PE2 or PE3 of positive polarity having a smaller pulse width than the sustain pulse PSx and a rectangular waveform is applied only to the main electrode Yb of the non-selected line that will be selected next. At this time, the erase pulse PE2 or PE3 is applied a little later than the sustain pulse PSx. As for the erase pulse PE2 shown in the figure, its falling edge coincides with that of the sustain pulse PSx. The erase pulse PE3 shown in the figure falls earlier than the sustain pulse PSx falls. Whichever erase pulse may be applied, PE2 or PE3, the pulse width of the sustain pulse PSx becomes substantially shorter, as clearly seen from the waveform of a relative drive voltage Vb across the main electrodes Yb and X. That is, the bias is canceled so soon after the surface discharge is generated that space charge is not allowed to be drawn. Therefore the wall charge is not reproduced and the wall voltage becomes almost zero.

Figure 7:
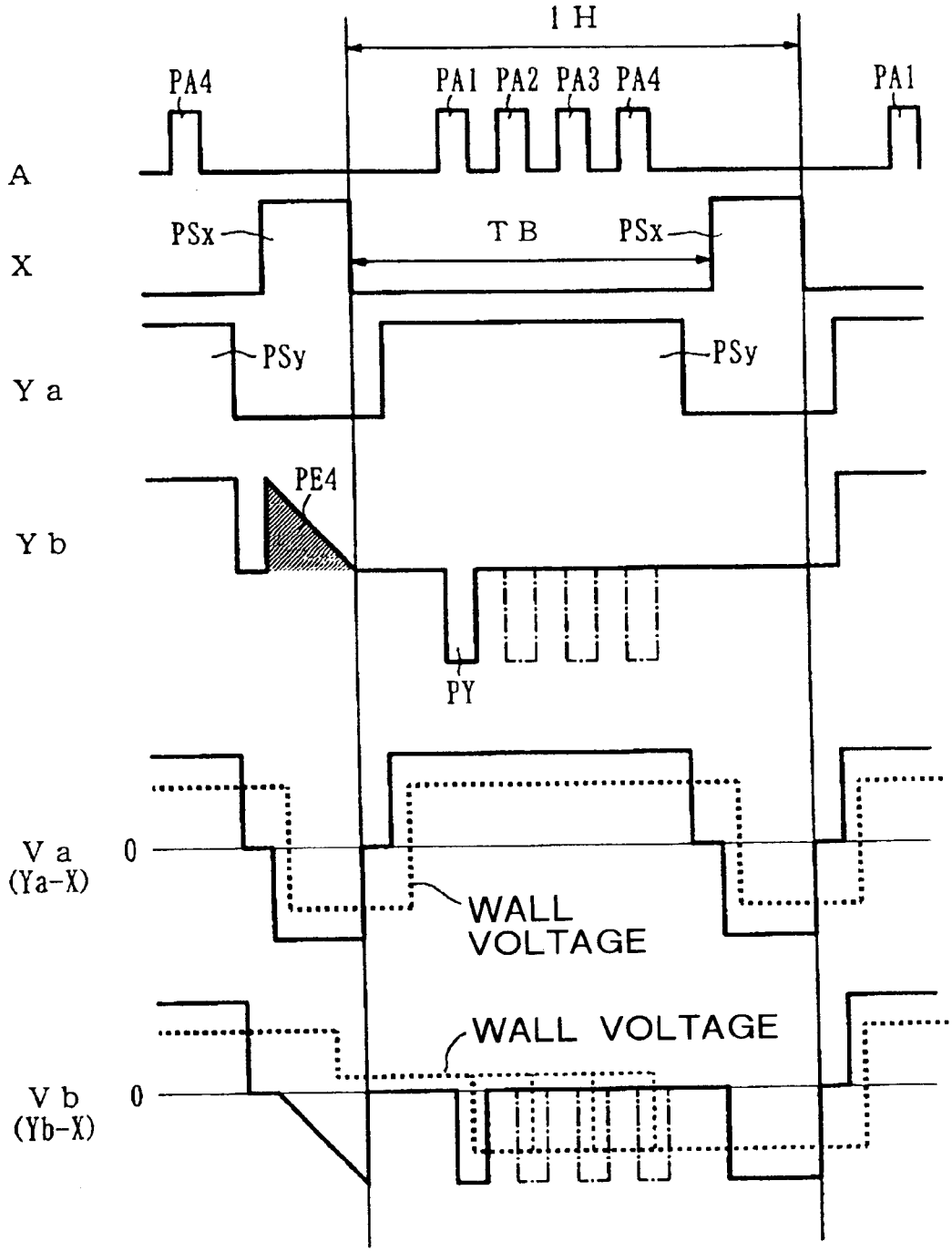
FIG. 7 illustrates voltage waveforms explaining a second modification related to the erasure of wall voltage.

FIG. 7 illustrates voltage waveforms explaining a second modification with regard to the erasure of wall voltage.

The sustain pulse PSy is applied commonly to the main electrodes Ya of all non-selected lines as in the example of FIG. 6. Then, at the same time as the sustain pulse PSx is applied to the main electrodes X, an erase pulse PE4 is applied only to the main electrode Yb of the non-selected line that will be selected next. The erase pulse PE4 is of positive polarity and has a saw-tooth waveform which rises steeply and then gradually declines. Thereby the waveform of the relative drive voltage Vb across the main electrodes Yb and X equals the waveform of the relative drive voltage in the case where the pulse of saw-tooth waveform whose voltage increases gradually is applied to the main electrode X. Thus, a weak surface discharge is generated to erase the wall charge and the wall voltage becomes almost zero.

Figure 8:
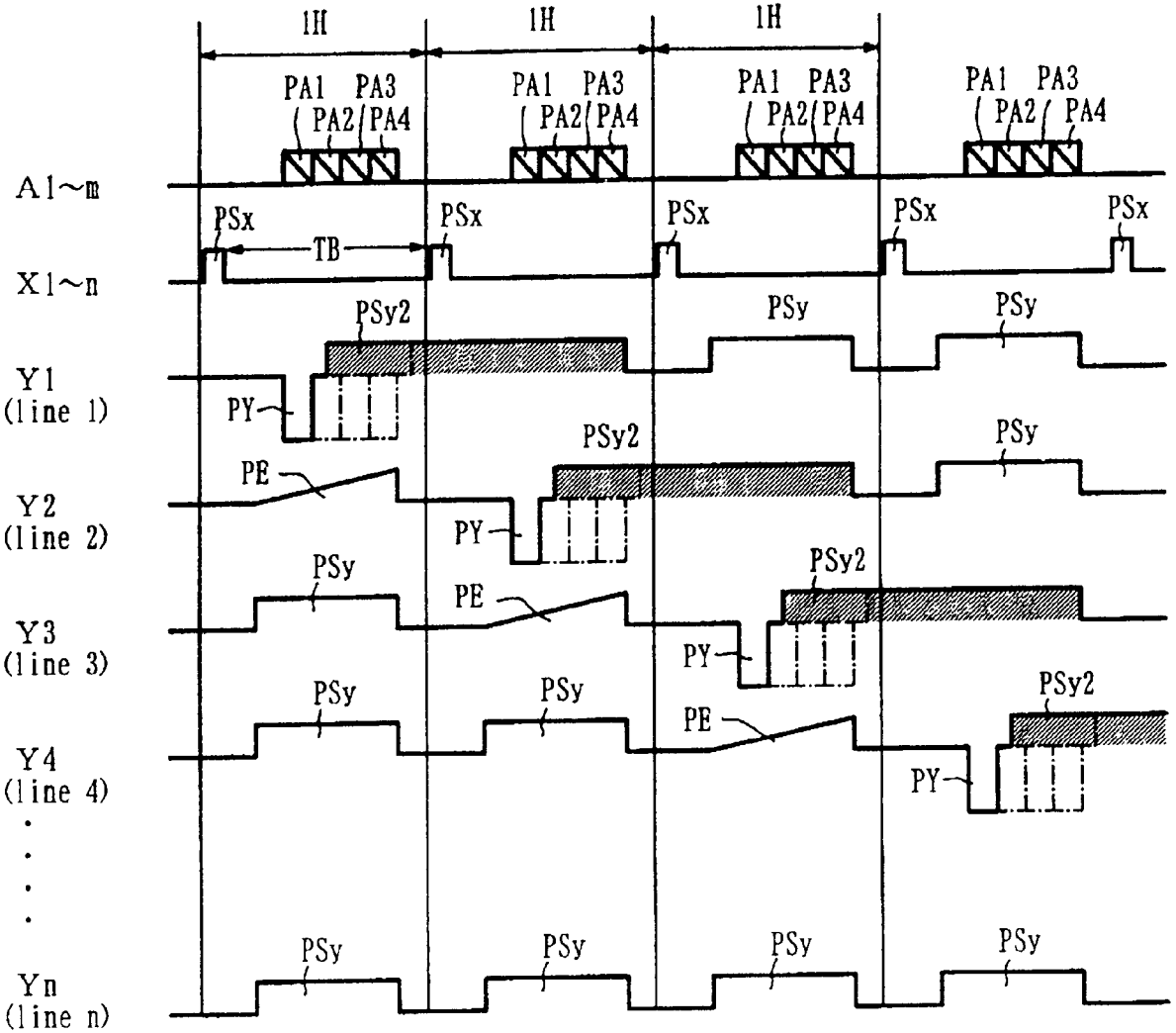
FIG. 8 illustrates waveforms explaining a modification related to the sustaining of illumination in accordance with the present invention.

FIG. 8 illustrates waveforms explaining a modification with regard to the sustaining of illumination.

In the drive sequence shown in FIG. 8, a sustain pulse PSy2 is applied to the main electrode Yb of the selected line immediately after the application of the scan pulse PY. The sustain pulse PSy2 has a pulse width long enough to include the sustain pulse PSy applied in the next pulse base time TB. The timing of applying the scan pulse PY differs in different sub-fields. Accordingly, the sustain pulse PSy2 has different pulse widths in different sub-fields. The drive sequence shown in FIG. 8 can ensure stable production of the wall charge and improve the reliability of driving.

Figures 9A, 9B:
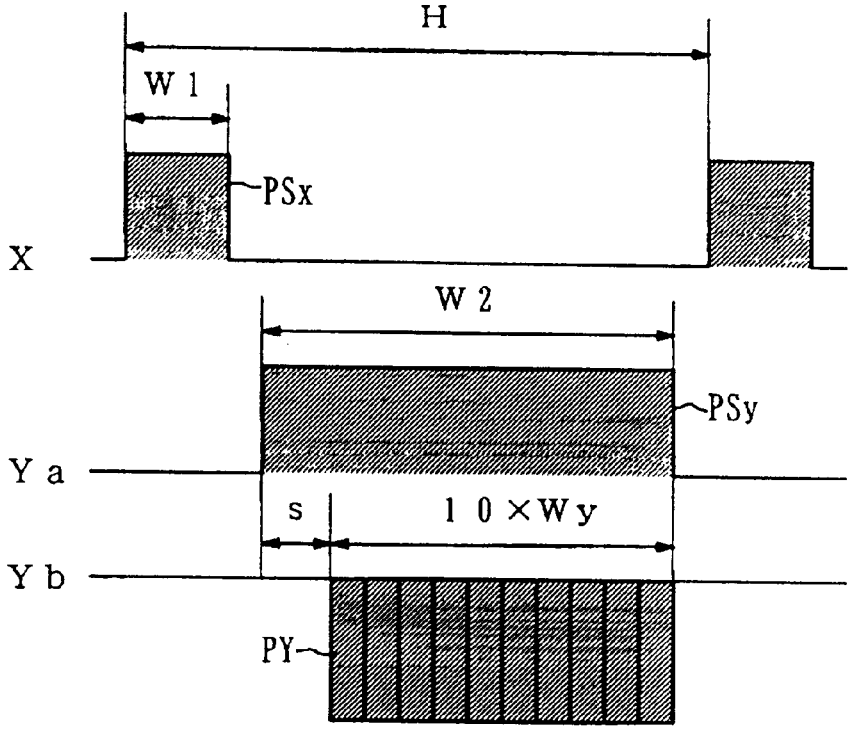
FIGS. 9A and 9B show voltage waveforms explaining the pulse width of an exemplary scan pulse.

FIGS. 9A and 9B illustrate voltage waveforms explaining examples of the pulse width Wy of the scan pulse PY. The figures show the case of displaying with 10 sub-fields.

Assuming that the number of fields (frames in the case of non-interlaced scanning) per second is 60 as in usual cases, the scanning time H is 1/(the number n of lines×60) seconds per line in each sub-field. In the drive sequence of the present invention, one sustain pulse PSx and one sustain pulse PSy are applied during the scanning time H. The minimum pulse width W2 of the sustain pulse PSy is the sum of the total pulse widths Wy of the k (k=10 in the figures) scan pulses and a time s set for the inversion of the polarity of the wall voltage. That is, the scanning time H is represented by the following formulae (2) and (3):

$$H=1/(n\times 60) \quad \text{Formula (2)}$$

$$H=W1+s+k\times Wy \quad \text{Formula (3)}$$

Here, if W1 is 3 μs and the set time s is 1.5 μs, the relationship between the number n of lines and the pulse width Wy is as shown in the table of FIG. 9B. For example, the pulse width Wy is 3.02 μs when the number n of lines is 480, and the pulse width Wy is 1.21 μs when the number n of lines is 1000. In the conventional drive sequence, the maximum number of sub-fields is 4 even if the width of the scan pulse is 1.21 μs or the number n of lines is 480. The present invention allows some leeway of time in the addressing and thus enables a remarkable increase in levels of gradation.

In the above described examples, the address pulses PA1 to PA4 are set to be positive for reducing deterioration of the fluorescent layers caused by the address discharges and then the polarity of the other pulses is decided. The pulses, however, is not limited to those of the described polarity. More particularly, the polarity of voltage applied may be inverse to that described in the examples. Or, in the addressing, the main electrodes X may be biased in order that the wall charge is efficiently produced on the main electrodes X. In this case, the pulse base time TB includes time for biasing.

According to the present invention, the addressing can be speeded up in the multi-line simultaneous driving which is advantageous for increasing the levels of gradation.

Further, according to the present invention, the structure of a circuit for selecting lines can be simplified.

Still further, according to the present invention, the sustaining of illumination can be less affected by the application of the pulses for the addressing.

What is claimed is:

1. A method for driving a plasma display panel having in a display region thereof a plurality of first main electrodes and a plurality of second main electrodes disposed in parallel to form electrode pairs for generating a discharge for sustaining illumination on each line and a plurality of address electrodes each disposed on each column to prepare a proper wall charge in each cell on a line basis, the method comprising:

applying an address pulse selectively to the address electrodes according to display data in synchronization with the application of a scan pulse;

periodically applying a first pulse for sustaining illumination to the first main electrodes;

selecting k lines, wherein k is an integer of 1 or more, during every pulse base time of the periodic application of the first pulse to the first main electrodes; and applying, to the second main electrodes on non-selected lines, a second pulse whose amplitude is a voltage for sustaining illumination, and applying the scan pulse sequentially to the second main electrodes on the selected k lines, during the pulse base time.

2. The method according to claim 1, wherein the second pulse applied to the second main electrodes has a larger pulse width than that of the first pulse applied to the first main electrodes.

3. The method according to claim 2, wherein, in a pulse base time in which the scan pulse is applied to the second main electrode, a third pulse whose pulse width is large enough to include the second pulse to be applied in the next pulse base time is applied to the second main electrode immediately after the application of the scan pulse.

4. The method according to claim 1, wherein the second pulse includes an erase pulse for erasing wall charge and a sustain pulse for sustaining illumination, the erase pulse having a gradually increasing voltage and being applied during the pulse base time to the second main electrode on a non-selected line that will be selected in a pulse base time later than said pulse base time, the sustain pulse having a quickly increasing voltage and being applied during the pulse base time to the second main electrodes on other non-selected lines.

5. The method according to claim 1, wherein, during each pulse base time, the second pulse for sustaining illumination is applied to the second main electrodes on all the non-selected lines and, in synchronization with the next application of the first pulse to the first main electrode, an erase pulse for generating a discharge for erasing wall charge is applied to the second main electrode on a non-selected line that will be selected in the next pulse base time.

6. The method according to claim 1, wherein, during each pulse base time, the first scan pulse is applied a pre-set time after a rising edge of the second pulse applied to the second main electrodes on the non-selected lines, the pre-set time being sufficient for inversion of the polarity of wall charge on the non-selected lines.

7. A method for driving a plasma display panel having, in a display region of m columns X n lines, a plurality of first main electrodes and a plurality of second main electrodes disposed in parallel to form electrode pairs for generating a discharge for sustaining illumination on each of the lines and m address electrodes disposed on each of the columns, a field being divided into k sub-fields each assigned a weight of luminance for reproducing levels of gradation, wherein k is an integer of one or more, for displaying time-sequential fields with the plasma display panel to execute addressing on a line basis to prepare a proper wall charge in each cell, the method comprising:

applying an address pulse selectively to the address electrodes according to display data in synchronization with the application of a scan pulse;

periodically applying a first pulse for sustaining illumination to the first main electrodes;

selecting k lines, wherein k is an integer of 1 or more, so that addressing is performed for k sub-fields having different weights of luminance out of 2k sub fields corresponding to two sequential fields, during every pulse base time of the periodic application of the first pulse to the first main electrodes; and applying, to the second main electrodes on non-selected lines, a second pulse whose amplitude is a voltage for sustaining illumination, and applying the scan pulse sequentially to the second main electrodes on the selected k lines, during the pulse base time.

8. The method according to claim 7, wherein, during each pulse base time, the k lines are selected in order of arrangement of the lines and the k lines are apart from each other by the numbers of lines corresponding to the weights of luminance assigned to the sub-fields.

9. The method according to claim 7, wherein k is 4.

10. The method according to claim 7, wherein the second pulse applied to the second main electrodes has a larger pulse width than that of the first pulse applied to the first main electrodes.

11. The method according to claim 10, wherein, in a pulse base time in which the scan pulse is applied to the second main electrode, a third pulse whose pulse width is large enough to include the second pulse to be applied in the next pulse base time is applied to the second main electrode immediately after the application of the scan pulse.

12. The method according to claim 7, wherein the second pulse includes an erase pulse for erasing wall charge and a sustain pulse for sustaining illumination, the erase pulse having a gradually increasing voltage and being applied during the pulse base time to the second main electrode on a non-selected line that will be selected in a pulse base time later than said pulse base time, the sustain pulse having a quickly increasing voltage and being applied during the pulse base time to the second main electrodes on other non-selected lines.

13. The method according to claim 7, wherein, during each pulse base time, the second pulse for sustaining illumination is applied to the second main electrodes on all the non-selected lines and, in synchronization with the next application of the first pulse to the first main electrode, an erase pulse for generating a discharge for erasing wall charge is applied to the second main electrode on a non-selected line that will be selected in the next pulse base time.

14. The method according to claim 7, wherein, during each pulse base time, the first scan pulse is applied a pre-set time after a rising edge of the second pulse applied to the second main electrodes on the non-selected lines, the pre-set time being sufficient for inversion of the polarity of wall charge on the non-selected lines.

15. A method for driving a plasma display panel having in a display region thereof a plurality of first main electrodes and a plurality of second main electrodes disposed in parallel to form electrode pairs for generating a discharge for sustaining illumination on each line and a plurality of address electrodes each disposed on each column to prepare a proper wall charge in each cell on a line basis, the method comprising:

applying an address pulse selectively to the address electrodes according to display data in synchronization with the application of a scan pulse;

periodically applying a first pulse for sustaining illumination to the first main electrodes;

selecting k lines, wherein k is an integer of 1 or more, during every pulse base time of the periodic application of the first pulse to the first main electrodes; and applying, to the second main electrodes on non-selected lines except second main electrodes to be selected in the next pulse base time, a second pulse whose amplitude is a voltage for sustaining illumination, and applying the scan pulse sequentially to the second main electrodes on the selected k lines, during said every pulse base time.

16. The method according to claim 15, wherein, during said every pulse base time, an erase pulse for generating a discharge for erasing the wall voltage is applied to said second main electrodes to be selected in the next pulse base time.

17. A method to drive a plasma display panel, comprising:

periodically applying a first sustain pulse to sustain illumination on first main electrodes;

selecting k lines during every pulse base time of the periodic application of the first pulse;

applying a second sustain pulse to second main electrodes on non-selected lines comprising a predetermined amplitude to sustain illumination;

applying a scan pulse sequentially to the second main electrodes on the selected k lines during every pulse base time; and applying an address pulse selectively to the address electrodes according to display data in synchronization with the application of the scan pulse.

18. The method according to claim 17, wherein k is an integer of 1 or more.

19. The method according to claim 17, wherein the predetermined amplitude is a voltage.

20. The method according to claim 17, wherein the second pulse applied to the second main electrodes has a larger pulse width than that of the first pulse applied to the first main electrodes.

21. The method according to claim 17, wherein the second pulse includes an erase pulse for erasing wall charge and a sustain pulse for sustaining illumination, the erase pulse comprising a gradually increasing voltage and being applied during the pulse base time to the second main electrode on a non-selected line that will be selected in a pulse base time later than said pulse base time, the sustain pulse having a quickly increasing voltage and being applied during the pulse base time to the second main electrodes on other non-selected lines.

* * * * *